US006973809B2

(12) United States Patent
Chang

(10) Patent No.: US 6,973,809 B2
(45) Date of Patent: Dec. 13, 2005

(54) NUMBER LOCK DEVICE FOR COMPUTER

(76) Inventor: Chun-Yuan Chang, P.O. Box 56 Ping Lin, Taichung Hsien (TW)

( * ) Notice: Subject to any disclaimer, the term of this patent is extended or adjusted under 35 U.S.C. 154(b) by 0 days.

(21) Appl. No.: 10/647,852

(22) Filed: Aug. 21, 2003

(65) Prior Publication Data

US 2004/0035158 A1 Feb. 26, 2004

(51) Int. Cl.[7] ..... E05B 69/00; E05B 73/00
(52) U.S. Cl. ..... 70/58; 70/14; 70/18
(58) Field of Search ..... 70/14, 18, 23, 70/30, 58, 312; 248/551–553

(56) References Cited

U.S. PATENT DOCUMENTS 3,756,046 A * 9/1973 Jeh ..... 70/25
4,610,152 A * 9/1986 Duringer ..... 70/30
5,899,099 A * 5/1999 Tsai ..... 70/26
6,058,744 A * 5/2000 Ling ..... 70/28
6,386,005 B1 * 5/2002 Kuo ..... 70/28
6,449,992 B1 * 9/2002 Yu et al. ..... 70/58
6,508,086 B2 * 1/2003 Chen ..... 70/49
6,523,373 B1 * 2/2003 Su ..... 70/58
6,536,244 B1 * 3/2003 Chang ..... 70/58
6,619,081 B1 * 9/2003 Yu ..... 70/58
6,672,117 B2 * 1/2004 Yu ..... 70/58

* cited by examiner

*Primary Examiner*—John B. Walsh
(74) *Attorney, Agent, or Firm*—Charles E. Baxley

(57) ABSTRACT

A number lock device, comprising a lock housing, a lock core, a cable, a cover, a movable member, a driving member, a locking plate, and a locking pin. Thus, the number lock device can be operated by the user's one hand only, thereby facilitating the user operating the number lock device. In addition, the correct numbers of the number rings of the lock core of the number lock device can be changed easily and conveniently.

17 Claims, 9 Drawing Sheets

NUMBER LOCK DEVICE FOR COMPUTER

BACKGROUND OF THE INVENTION

1. Field of the Invention

The present invention relates to a number lock device for locking a computer, and more particularly to a number lock device that can be operated by the user's one hand only, thereby facilitating the user operating the number lock device.

2. Description of the Related Art

A conventional lock device in accordance with the prior art shown in FIGS. 1–4 comprises a housing 1, an inner barrel 2 inserted into the housing 1 and having a distal end having a periphery formed with an outer ring 201 and having an end face formed with a through hole (not shown) for passage of a key (not shown), a mounting ring 4 mounted on the inner barrel 2 located between the housing 1 and the outer ring 201 and provided with a cable 401, and a lock core 3 mounted in the inner barrel 2. The lock core 3 includes a positioning ring 303 having an end face provided with two spaced locking tongues 304 protruding outward from the housing 1, and a lock bolt 301 rotatably mounted in the inner barrel 2 and having a first end formed with a key hole (not shown) communicating with the through hole for passage of the key and a second end formed with an enlarged head 302 extending between the two locking tongues 304 and protruding outward from the housing 1.

In operation, the cable 401 is passed through a fixed upright or leg, and the housing 1 is then passed through the loop 402 of a distal end of the cable 401 as shown in FIG. 3. In such a manner, when the enlarged head 302 is aligned with the connecting line between the two locking tongues 304 as shown in FIG. 1, the lock core 3 is disposed at an unlocked state. Thus, the enlarged head 302 and the two locking tongues 304 can be inserted into the elongated slot 901 of the shell 9 of a computer, and the enlarged head 302 can be extended into the elongated slot 92 of the shell 90. Then, the key is rotated to rotate the lock core 3, so that the lock core 3 is disposed at an unlocked state. At this time, the two locking tongues 304 are fixed by the wall of the elongated slot 901 without rotation, so that the enlarged head 302 can be rotated from the position as shown in FIG. 1 to the position as shown in FIG. 4, where the enlarged head 302 is vertical to the connecting line between the two locking tongues 304. At this time, the enlarged head 302 is rested on and locked by the inner wall of the shell 9 of the computer, so that the conventional lock device is locked on the shell 9 of the computer as shown in FIG. 3, thereby providing an anti-theft function. However, the conventional lock device is operated by the user's two hands, thereby causing inconvenience to the user.

The closest prior art of which the applicant is aware is disclosed in his U.S. Pat. No. 6,536,244, entitled "COMPUTER SECURITY DEVICE".

SUMMARY OF THE INVENTION

The primary objective of the present invention is to provide a number lock device that can be operated by the user's one hand only, thereby facilitating the user operating the number lock device.

Another objective of the present invention is to provide a number lock device, wherein the correct numbers of the number rings of the lock core of the number lock device can be changed easily and conveniently.

In accordance with the present invention, there is provided a number lock device, comprising a lock housing, a lock core, and a cover, wherein:

the lock housing has a first end having an inside formed with a receiving chamber, the lock housing has two opposite faces each formed with a plurality of through holes and has a side formed with a plurality of windows;

the lock core is mounted in the lock housing and includes a plurality of number rings each rotatably mounted in a respective one of the through holes of the lock housing, a first locking ring and a plurality of second locking rings each mounted in a respective one of the number rings, and a lock core rod having a first end provided with a catch plate and a second end extended through a spring and each of the first locking ring and the second locking rings;

the number lock device further comprises a movable member, a driving member, a locking plate, and a locking pin each mounted in the receiving chamber of the lock housing and located between the lock core and the cover;

the movable member has a first side formed with a rectangular insertion recess for insertion of the catch plate of the lock core rod and a second side formed with four triangular first teeth and four first engaging grooves each located between any two adjacent first teeth;

the driving member is engaged with the movable member and has a first side formed with four triangular second teeth each mounted in a respective one of the first engaging grooves of the movable member and four second engaging grooves each located between any two adjacent second teeth, wherein each of the first teeth of the movable member is mounted in a respective one of the second engaging grooves of the driving member, the driving member has a second side formed with an insertion groove;

the locking plate has a first end inserted into the insertion groove of the driving member and formed with a mounting hole, and a second end formed with two locking legs extended through the cover and a channel located between the two locking legs and communicating with the mounting hole; and the locking pin is pivotally mounted in the channel of the locking plate and has a first end mounted in the mounting hole of the locking plate and locked on the lock housing and has a second end formed with a locking block extended outward from the channel of the locking plate and the cover.

Further benefits and advantages of the present invention will become apparent after a careful reading of the detailed description with appropriate reference to the accompanying drawings.

DETAILED DESCRIPTION OF THE INVENTION

Figure 1:
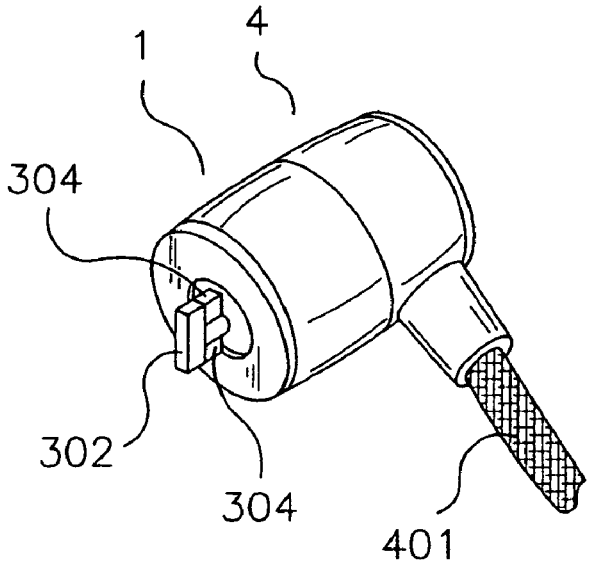
FIG. 1 PRIOR ART
FIG. 1 is a partially cut-away perspective view of a conventional lock device in accordance with the prior art.
Figure 3:
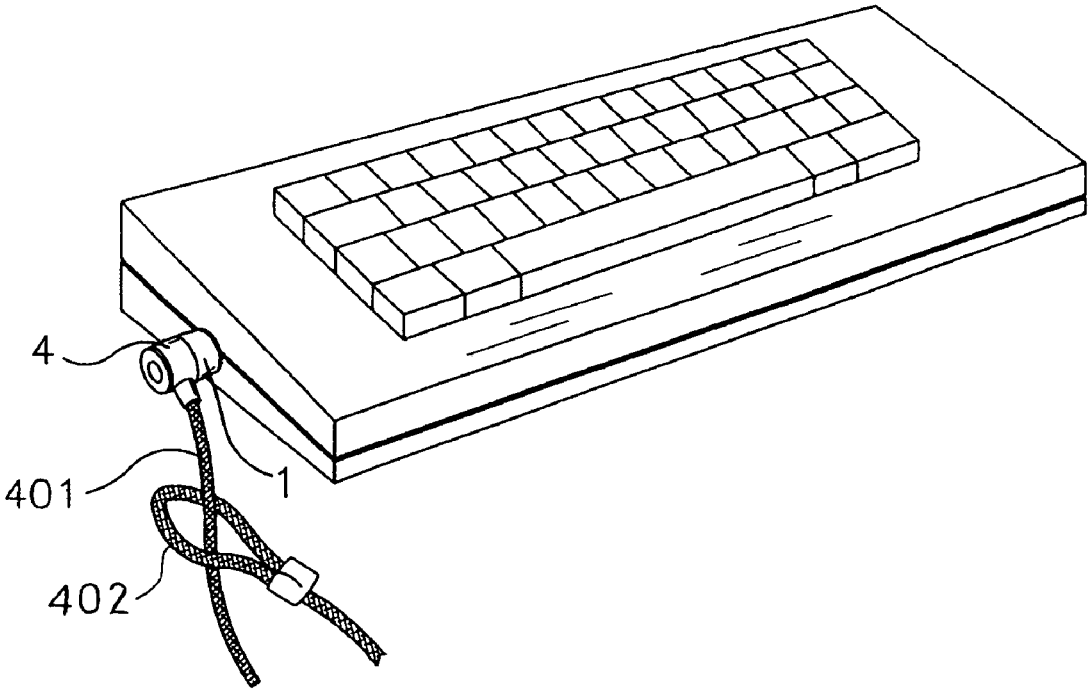
FIG. 3 PRIOR ART
FIG. 3 is a perspective operational view of the conventional lock device as shown in FIG. 1.
Figure 2:
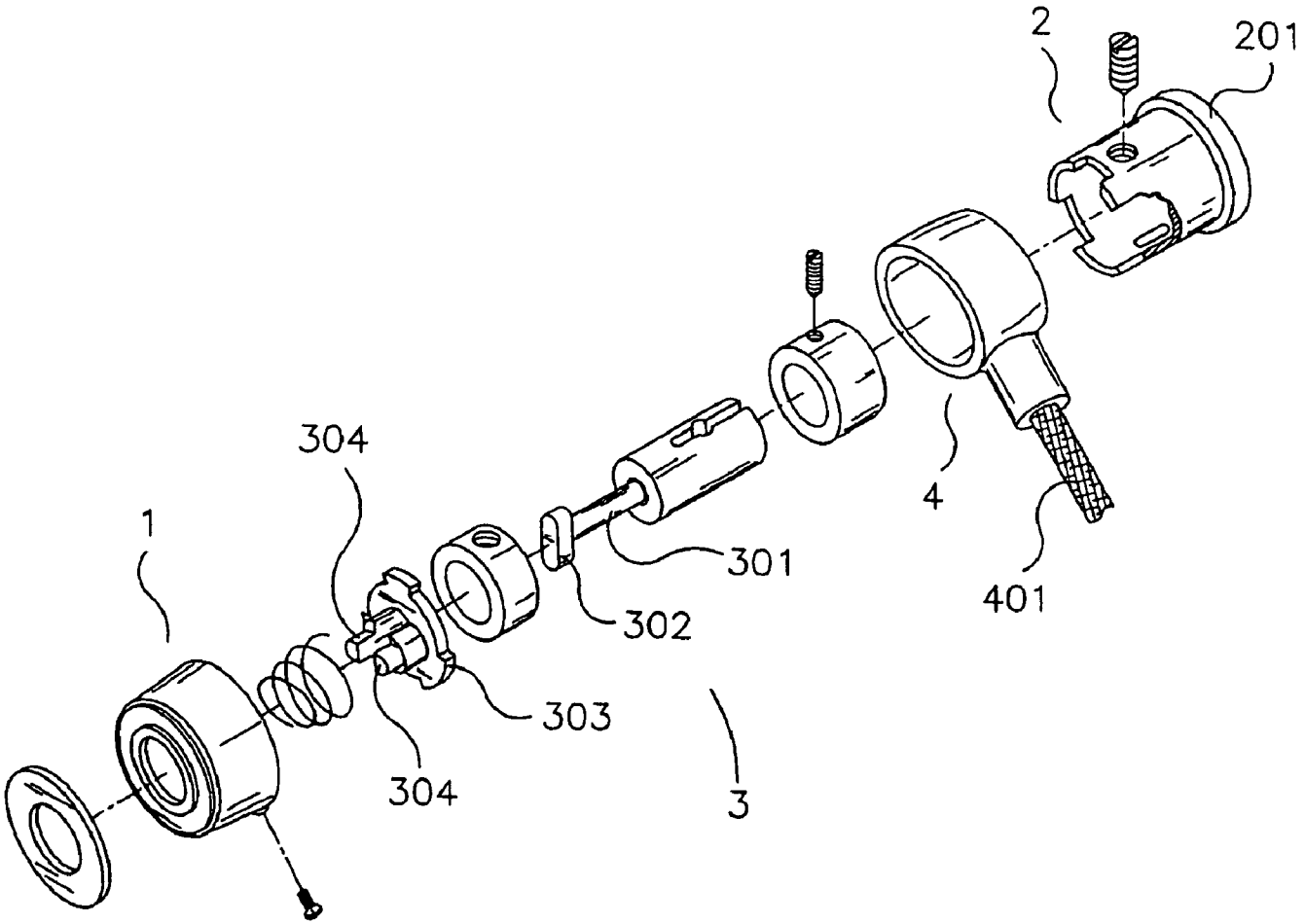
FIG. 2 PRIOR ART
FIG. 2 is an exploded perspective view of the conventional lock device as shown in FIG. 1.
Figure 4:
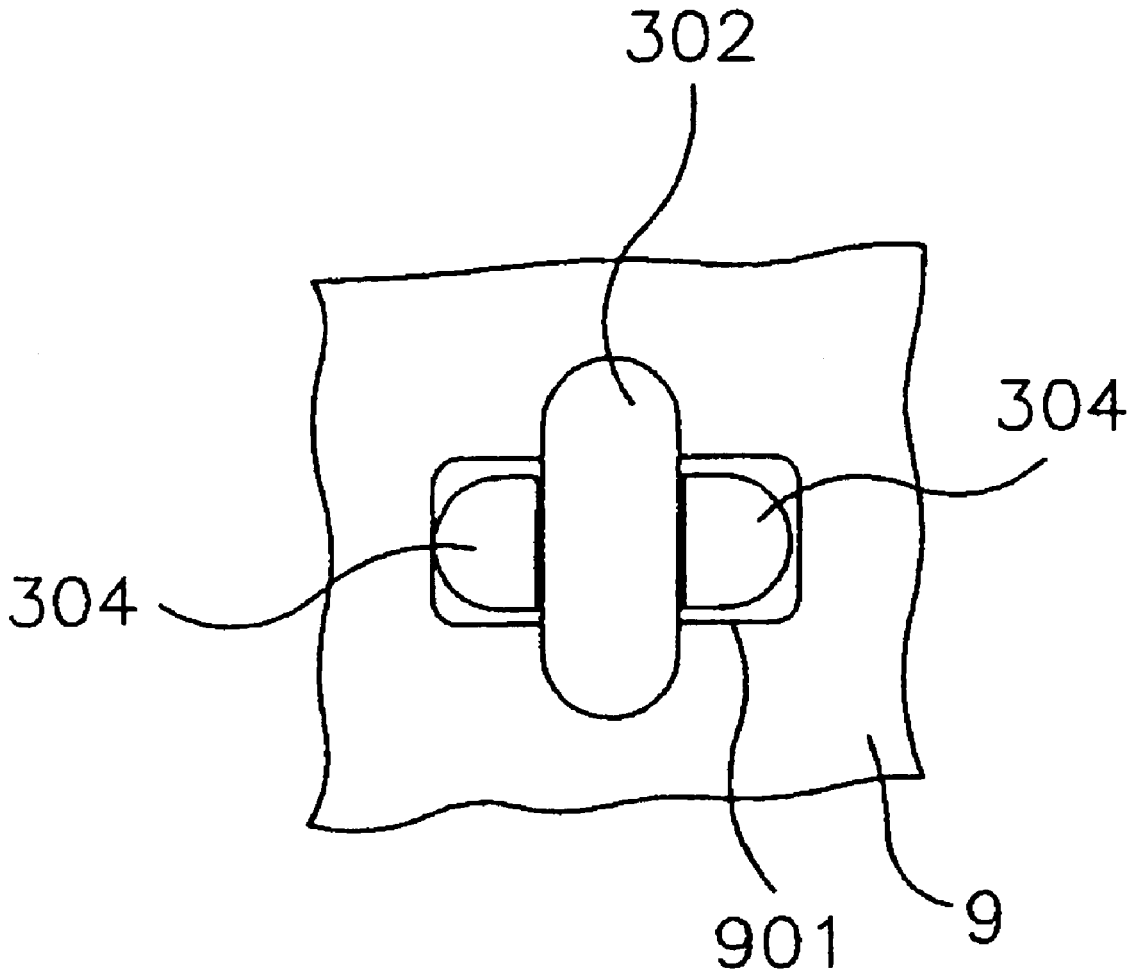
FIG.4 PRIOR ART
FIG. 4 is a partially cut-away side plan operational view of the conventional lock device as shown in FIG. 3.

Referring to the drawings and initially to FIGS. 5–10, a number lock device in accordance with the preferred embodiment of the present invention comprises a lock housing 10, a lock core 20, a cover 30, and a cable 40.

The lock housing 10 has a first end formed with a pivot sleeve 11 and a second end provided with a movable push button 13. The first end of the lock housing 10 has an inside formed with a receiving chamber 19. The receiving chamber 19 of the lock housing 10 has a wall formed with two opposite elongated guide grooves 192 and two opposite locking grooves 15. The lock housing 10 includes a first shell 12 and a second shell 14 combined with each other. The lock housing 10 has two opposite faces each formed with a plurality of through holes 16 and has a side formed with a plurality of windows 18. The second end of the lock housing 10 is formed with an elongated receiving hole 17 for receiving the push button 13.

The push button 13 includes a slide 136 (see FIG. 8) slidably mounted in the receiving hole 17 of the lock housing 10, a push plate 132 mounted on a first side of the slide 136 and protruded outward from the receiving hole 17 of the lock housing 10, and a guide plate 134 mounted on a second side of the slide 136 and extended into the receiving hole 17 of the lock housing 10. The guide plate 134 of the push button 13 is provided with a protruding urging portion 138 facing the lock core 20 and having an end formed with an oblique guide face 1382.

The lock core 20 is mounted in the lock housing 10 and includes a plurality of number rings 21 each rotatably mounted in a respective one of the through holes 16 of the lock housing 10, a first locking ring 22 and a plurality of second locking rings 23 each mounted in a respective one of the number rings 21, a lock core rod 24 having a first end provided with a catch plate 242 and a second end extended through a spring 244 and each of the first locking ring 22 and the second locking rings 23, and a reed 25 located in the lock housing 10 and mounted on the number rings 21. The first locking ring 22 has an end formed with a lug 222 rested on the guide face 1382 of the urging portion 138 of the guide plate 134 of the push button 13. The spring 244 has a first end rested on the catch plate 242 of the lock core rod 24 and a second end rested on one of the second locking rings 23.

The number lock device further comprises a movable member 50, a driving member 60, a locking plate 70, and a locking pin 80 each mounted in the receiving chamber 19 of the lock housing 10 and located between the lock core 20 and the cover 30.

The movable member 50 has a periphery formed with two opposite ears 52 each movably mounted in a respective one of the two guide grooves 192 of the receiving chamber 19 of the lock housing 10, so that the movable member 50 is movably mounted in the receiving chamber 19 of the lock housing 10 without rotation. The movable member 50 has a first side formed with a rectangular insertion recess 54 (see FIG. 9) for insertion of the catch plate 242 of the lock core rod 24, so that the lock core rod 24 of the lock core 20 is positioned on the movable member 50 without rotation. The movable member 50 has a second side formed with four symmetrically arranged triangular first teeth 56 arranged in a radiating manner and four first engaging grooves 58 each located between any two adjacent first teeth 56. Each of the first teeth 56 of the movable member 50 has two sides formed with two symmetrically arranged first inclined face 562.

The driving member 60 is mounted between the movable member 50 and the cover 30 and is engaged with the movable member 50. The driving member 60 has a first side formed with four symmetrically arranged triangular second teeth 62 each mounted in a respective one of the first engaging grooves 58 of the movable member 50 and four second engaging grooves 64 each located between any two adjacent second teeth 62. Each of the first teeth 56 of the movable member 50 is mounted in a respective one of the second engaging grooves 64 of the driving member 60. Each of the second teeth 62 of the driving member 60 has two sides formed with two symmetrically arranged second inclined face 622. The driving member 60 has a second side formed with an insertion groove 66.

The locking plate 70 has a first end inserted into the insertion groove 66 of the driving member 60 and formed with a mounting hole 72, and a second end formed with two locking legs 74 extended through the cover 30 and a channel 742 located between the two locking legs 74 and communicating with the mounting hole 72.

Figure 5:
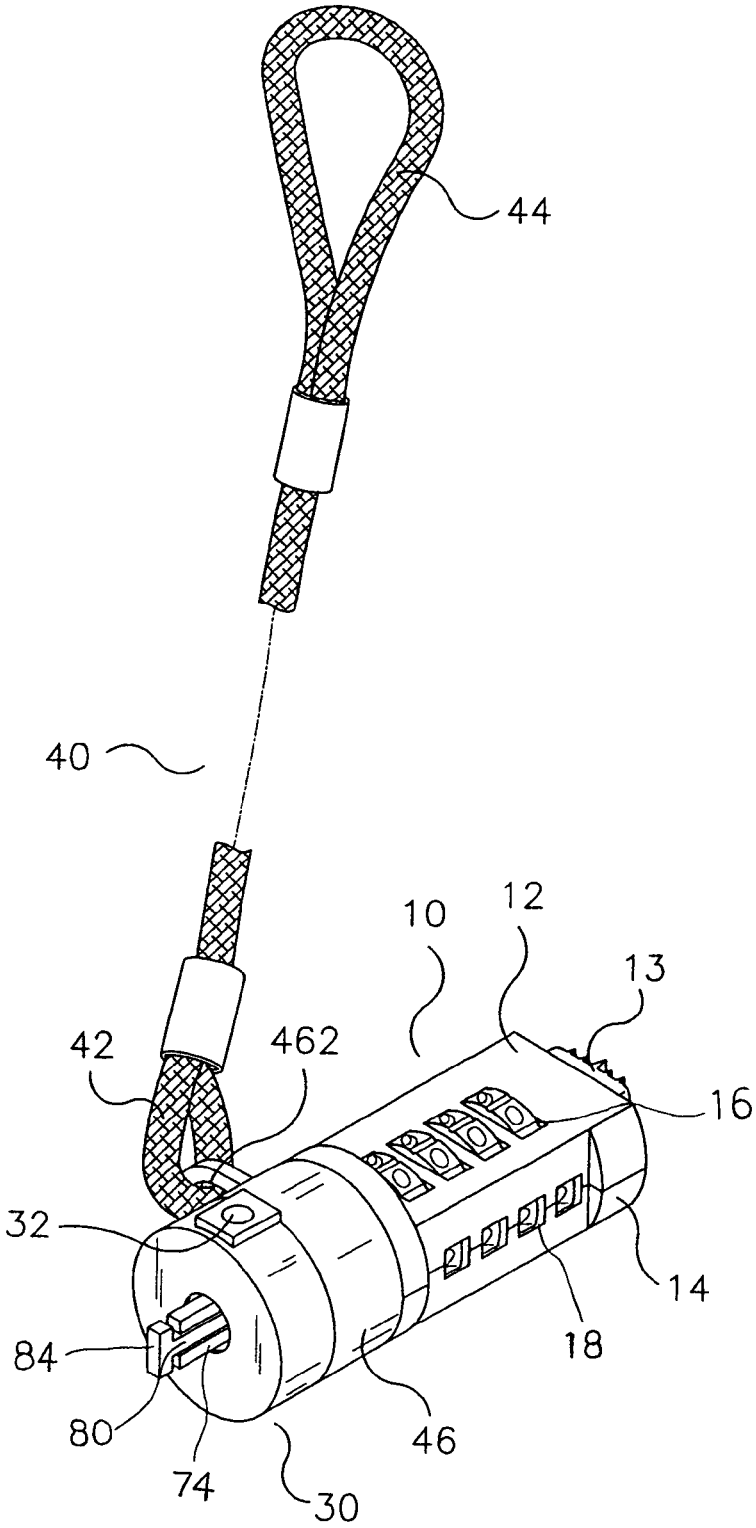
FIG. 5 is a partially cut-away perspective view of a number lock device in accordance with the preferred embodiment of the present invention.

The locking pin 80 is pivotally mounted in the channel 742 of the locking plate 70 and has a first end mounted in the mounting hole 72 of the locking plate 70 and having two sides each formed with a wing plate 82 extended outward from a wall of the mounting hole 72 of the locking plate 70 and locked in a respective one of the two locking grooves 15 of the receiving chamber 19 of the lock housing 10, so that the locking pin 80 is moved in concert with the lock housing 10. The locking pin 80 has a second end formed with a locking block 84 extended outward from the channel 742 of the locking plate 70 and the cover 30 as shown in FIG. 5.

The cable 40 has a first end formed with a first loop 42 mounted on a fixing ear 462 of a mounting ring 46 which is mounted on the pivot sleeve 11 of the lock housing 10. The cable 40 has a second end formed with a second loop 44. The second loop 44 of the cable 40 is passed through a fixed upright or leg, and the lock housing 10 is then passed through the second loop 44 of the cable 40 as shown in FIG. 7.

The cover 30 is mounted on the pivot sleeve 11 of the lock housing 10 and is rested on the mounting ring 46 to position the lock core 20 in the lock housing 10. The cover 30 is fixed on the pivot sleeve 11 of the lock housing 10 by a pin 32. The cover 30 has an inside formed with two protruding press blocks 34 to press the wing plate 82 of the locking pin 80 to position the wing plate 82 of the locking pin 80 in a respective one of the two locking grooves 15 of the receiving chamber 19 of the lock housing 10.

In operation, referring to FIGS. 5–12, when the number rings 21 of the lock core 20 are rotated to the correct numbers, the lock core 20 is disposed at an unlocked state, so that the lock core rod 24 of the lock core 20 is movable in the lock housing 10.

Figure 7:
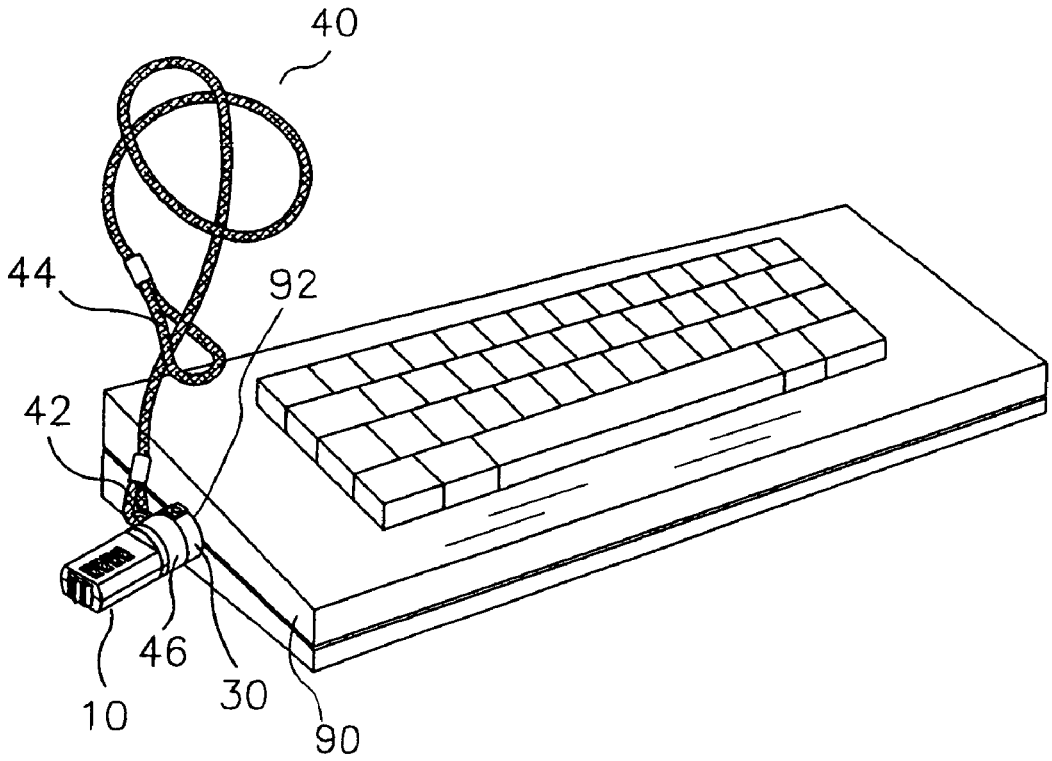
FIG. 7 is a perspective operational view of the number lock device as shown in FIG. 5.
Figure 8:
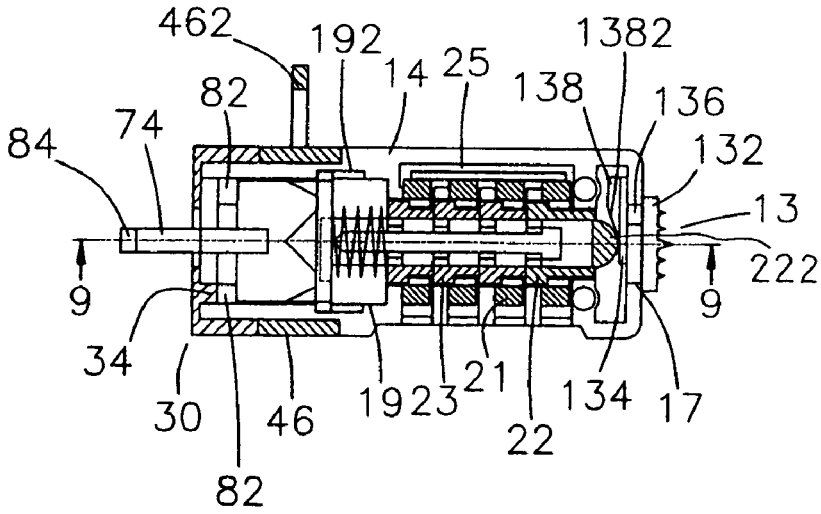
FIG. 8 is a plan cross-sectional view of the number lock device as shown in FIG. 5.
Figure 9:
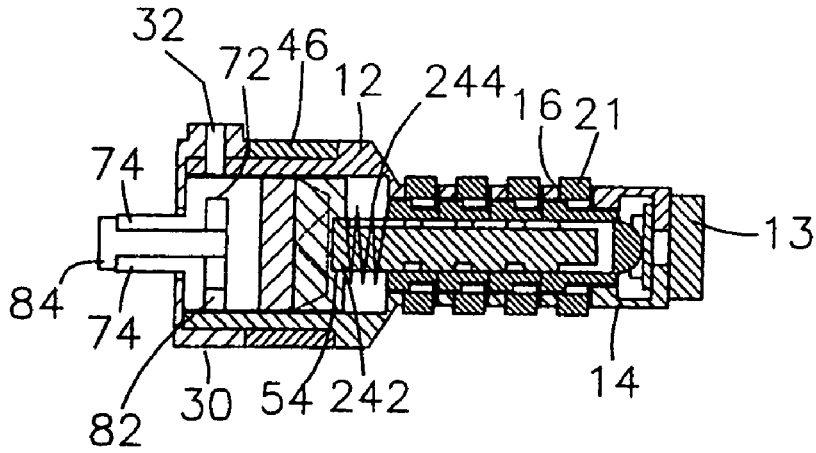
FIG. 9 is a plan cross-sectional view of the number lock device taken along line 9—9 as shown in FIG. 8.

The locking block 84 of the locking pin 80 is initially aligned with the connecting line between the two locking legs 74 of the locking plate 70 as shown in FIG. 5, so that the locking block 84 of the locking pin 80 and the two locking legs 74 of the locking plate 70 can be inserted into the elongated slot 92 of the shell 90 of a computer as shown in FIG. 7, and the locking block 84 of the locking pin 80 can be extended into the elongated slot 92 of the shell 90.

At this time, the two locking legs 74 of the locking plate 70 are fixed by the wall of the elongated slot 92 without rotation, so that the locking plate 70 and the driving member 60 are fixed and cannot be rotated by the lock housing 10, while the movable member 50 and the locking pin 80 can be rotated by the lock housing 10.

Figure 10:
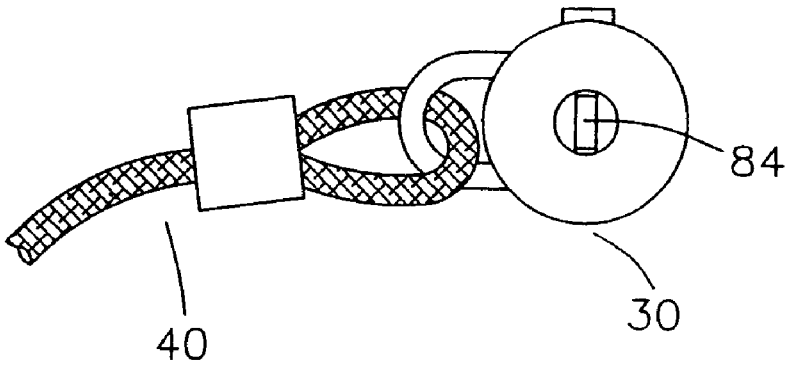
FIG. 10 is a plan operational view of the number lock device as shown in FIG. 5.
Figure 11:
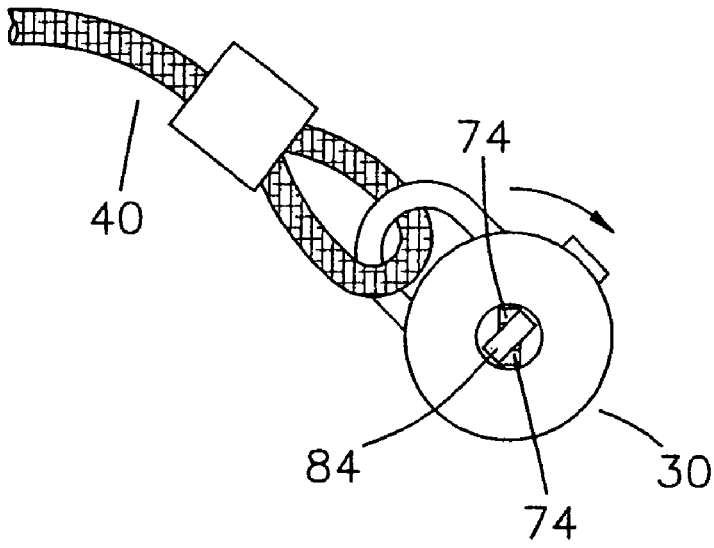
FIG. 11 is an operational view of the number lock device as shown in FIG. 10.
Figure 12:
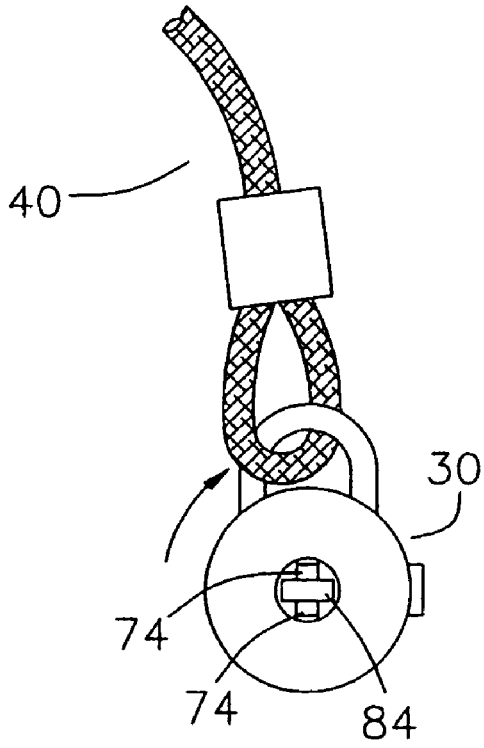
FIG. 12 is an operational view of the number lock device as shown in FIG. 11.

Then, the lock housing 10 can be rotated to rotate the movable member 50 and the locking pin 80, so that the locking pin 80 is rotated relative to the locking plate 70, and the movable member 50 is rotated relative to the driving member 60. Thus, the locking block 84 of the locking pin 80 can be rotated from the position as shown in FIG. 10 to the position as shown in FIG. 11 and then to the position as shown in FIG. 12, so that the locking block 84 of the locking pin 80 is vertical to the connecting line between the two locking legs 74 of the locking plate 70.

At this time, the locking block 84 of the locking pin 80 is rested on and locked by the inner wall of the shell 90 of the computer, so that the number lock device is locked on the shell 90 of the computer as shown in FIG. 7.

Then, the number rings 21 of the lock core 20 are rotated to the incorrect numbers, so that the lock core rod 24 of the lock core 20 is locked by the first locking ring 22 and the second locking rings 23 without movement, and the lock core 20 is disposed at a locked state. At this time, the movable member 50 is engaged with the driving member 60, and the lock core rod 24 of the lock core 20 is rested on the movable member 50, so that the movable member 50 is fixed without movement and the lock housing 10 cannot be rotated, thereby providing an anti-theft function.

Accordingly, the user only needs to insert the locking block 84 of the locking pin 80 and the two locking legs 74 of the locking plate 70 into the elongated slot 92 of the shell 90 of the computer and to rotate the lock housing 10 so as to lock the number lock device, so that the number lock device can be operated by the user's one hand only, thereby facilitating the user operating the number lock device.

Figure 6:
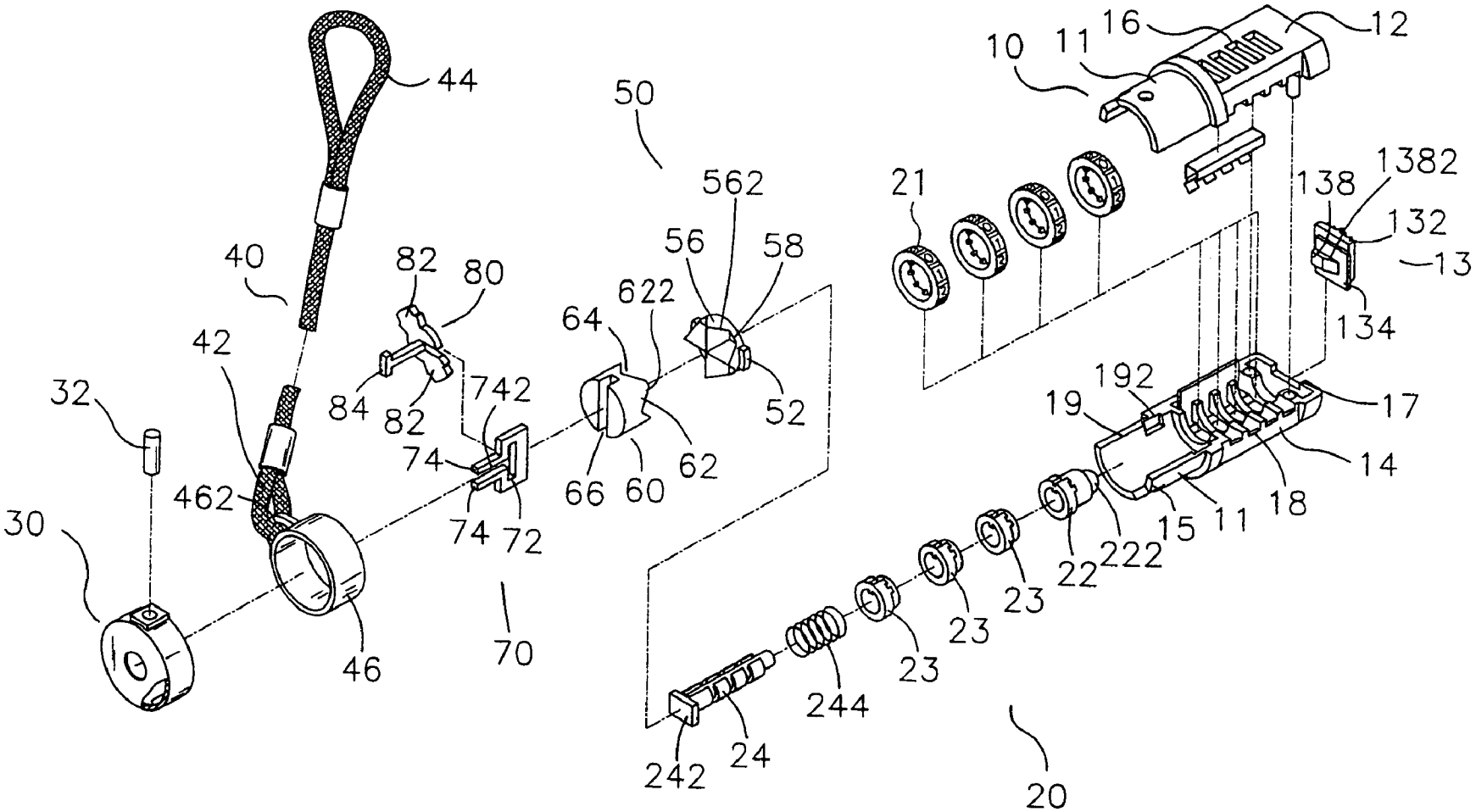
FIG. 6 is an exploded perspective view of the number lock device as shown in FIG. 5.
Figure 13:
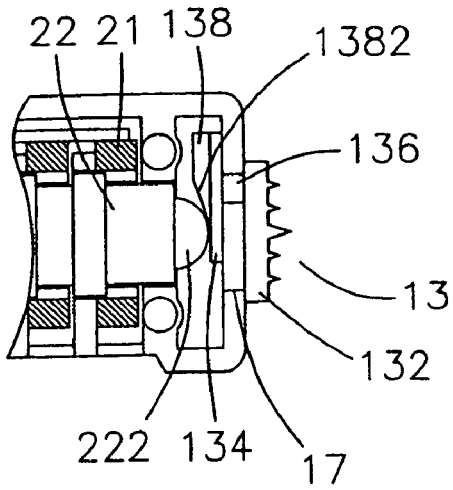
FIG. 13 is a partially cut-away enlarged view of the number lock device as shown in FIG. 8.
Figure 14:
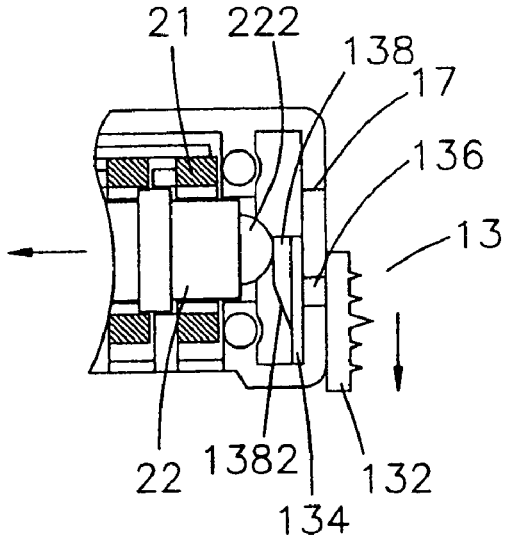
FIG. 14 is an operational view of the number lock device as shown in FIG. 13.

Referring to FIGS. 13 and 14 with reference to FIG. 6, the number rings 21 of the lock core 20 are rotated to the correct numbers, thereby releasing the locking state between the lock core rod 24 of the lock core 20 and the first locking ring 22 and the second locking rings 23 of the lock housing 10, so that the lock core rod 24 of the lock core 20 can be moved relative to the first locking ring 22 and the second locking rings 23 of the lock housing 10. Then, the push button 13 is pushed to move the guide plate 134, so that the urging portion 138 of the guide plate 134 is moved from the position as shown in FIG. 13 to the position as shown in FIG. 14, to push and move the lug 222 of the first locking ring 22, thereby axially moving the first locking ring 22 and the second locking rings 23 gradually, and thereby compressing the spring 244.

At this time, the push button 13, the first locking ring 22 and the second locking rings 23 are disposed at a positioning state, and will not be returned to the original position after the force applied on the push button 13 is released. Then, the number rings 21 of the lock core 20 are rotated to the new correct numbers. At this time, the first locking ring 22 and the second locking rings 23 are not rotated with the number rings 21 of the lock core 20. Then, the push button 13 is pushed backward to release the urging portion 138 of the guide plate 134 from the lug 222 of the first locking ring 22. At this time, the first locking ring 22 and the second locking rings 23 are returned to the original position by the restoring force of the spring 244, and are locked with the number rings 21 of the lock core 20. Thus, the correct numbers of the number rings 21 of the lock core 20 can be changed easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A number lock device, comprising a lock housing, a lock core, and a cover, wherein:

the lock housing has a first end having an inside formed with a receiving chamber, the lock housing has two opposite faces each formed with a plurality of through holes and has a side formed with a plurality of windows;

the lock core is mounted in the lock housing and includes a plurality of number rings each rotatably mounted in a respective one of the through holes of the lock housing, a first locking ring and a plurality of second locking rings each mounted in a respective one of the number rings, and a lock core rod having a first end provided with a catch plate and a second end extended through a spring and each of the first locking ring and the second locking rings;

the number lock device further comprises a movable member, a driving member, a locking plate, and a locking pin each mounted in the receiving chamber of the lock housing and located between the lock core and the cover;

the movable member has a first side formed with a rectangular insertion recess for insertion of the catch plate of the lock core rod and a second side formed with four triangular first teeth and four first engaging grooves each located between any two adjacent first teeth;

the driving member is engaged with the movable member and has a first side formed with four triangular second teeth each mounted in a respective one of the first engaging grooves of the movable member and four second engaging grooves each located between any two adjacent second teeth, wherein each of the first teeth of the movable member is mounted in a respective one of the second engaging grooves of the driving member, the driving member has a second side formed with an insertion groove;

the locking plate has a first end inserted into the insertion groove of the driving member and formed with a mounting hole, and a second end formed with two locking legs extended through the cover and a channel located between the two locking legs and communicating with the mounting hole; and the locking pin is pivotally mounted in the channel of the locking plate and has a first end mounted in the mounting hole of the locking plate and locked on the lock housing and has a second end formed with a locking block extended outward from the channel of the locking plate and the cover.

2. The number lock device in accordance with claim 1, wherein the receiving chamber of the lock housing has a wall formed with two opposite elongated guide grooves, and the movable member has a periphery formed with two opposite ears each movably mounted in a respective one of the two guide grooves of the receiving chamber of the lock housing, so that the movable member is movably mounted in the receiving chamber of the lock housing without rotation.

3. The number lock device in accordance with claim 1, wherein the receiving chamber of the lock housing has a wall formed with two opposite locking grooves, and the first end of the locking pin has two sides each formed with a wing plate extended outward from a wall of the mounting hole of the locking plate and locked in a respective one of the two locking grooves of the receiving chamber of the lock housing, so that the locking pin is moved in concert with the lock housing.

4. The number lock device in accordance with claim 1, wherein the lock core further includes a reed located in the lock housing and mounted on the number rings.

5. The number lock device in accordance with claim 1, wherein the spring has a first end rested on the catch plate of the lock core rod and a second end rested on one of the second locking rings.

6. The number lock device in accordance with claim 1, wherein each of the first teeth of the movable member has two sides formed with two symmetrically arranged first inclined face.

7. The number lock device in accordance with claim 1, wherein each of the second teeth of the driving member has two sides formed with two symmetrically arranged second inclined face.

8. The number lock device in accordance with claim 1, wherein the lock housing includes a first shell and a second shell combined with each other.

9. The number lock device in accordance with claim 1, wherein the first end of the lock housing is formed with a pivot sleeve.

10. The number lock device in accordance with claim 9, further comprising a cable having a first end formed with a first loop mounted on a fixing ear of a mounting ring which is mounted on the pivot sleeve of the lock housing and having a second end formed with a second loop.

11. The number lock device in accordance with claim 10, wherein the cover is mounted on the pivot sleeve of the lock housing and is rested on the mounting ring to position the lock core in the lock housing.

12. The number lock device in accordance with claim 9, wherein the cover is fixed on the pivot sleeve of the lock housing by a pin.

13. The number lock device in accordance with claim 3, wherein the cover has an inside formed with two protruding press blocks to press the wing plate of the locking pin to position the wing plate of the locking pin in a respective one of the two locking grooves of the receiving chamber of the lock housing.

14. The number lock device in accordance with claim 1, wherein the lock housing has a second end provided with a movable push button including a slide slidably mounted in the receiving hole of the lock housing, a push plate mounted on a first side of the slide and protruded outward from the receiving hole of the lock housing, and a guide plate mounted on a second side of the slide and extended into the receiving hole of the lock housing.

15. The number lock device in accordance with claim 14, wherein the second end of the lock housing is formed with an elongated receiving hole for receiving the push button.

16. The number lock device in accordance with claim 14, wherein the guide plate of the push button is provided with a protruding urging portion, and the first locking ring has an end formed with a lug rested on the urging portion of the guide plate of the push button.

17. The number lock device in accordance with claim 16, wherein the urging portion of the guide plate of the push button has an end formed with an oblique guide face, and the lug of the first locking ring is rested on the guide face of the urging portion of the guide plate of the push button.

* * * * *